United States Patent [19]

Bove

[11] Patent Number: 4,958,671

[45] Date of Patent: Sep. 25, 1990

[54] FOLDABLE DISPLAY SYSTEM WITH CONTINUOUS DISPLAY SURFACE

[76] Inventor: Thomas A. Bove, 1154 Herschel Ave., Cincinnati, Ohio 45208

[21] Appl. No.: 406,369

[22] Filed: Sep. 12, 1989

[51] Int. Cl.[5] ..... A47G 5/00

[52] U.S. Cl. ..... 160/135; 160/351

[58] Field of Search ..... 160/135, 351, 369, 381, 160/379, DIG. 16, 371; 52/475, 239, DIG. 14; 40/605, 575

[56] References Cited

U.S. PATENT DOCUMENTS

| | | | |
|---|---|---|---|
| Re. 30,777 | 10/1981 | Ytter . | |
| D. 227,943 | 3/1985 | Beckrot . | |
| D. 271,732 | 12/1983 | Ytter . | |
| 465,290 | 4/1890 | Boughton . | |
| 1,944,696 | 10/1933 | Reichl . | |
| 3,037,593 | 6/1962 | Webster | 160/135 X |
| 3,111,728 | 8/1960 | Alderfer . | |
| 3,501,800 | 5/1967 | O'Dea . | |
| 3,592,289 | 7/1971 | Aysta et al. | 160/135 |
| 3,695,330 | 10/1972 | Hasbrouck | 160/135 |
| 3,768,222 | 10/1973 | Birum, Jr. . | |
| 3,852,935 | 12/1974 | Jones . | |
| 3,875,721 | 4/1975 | Mengeringhausen et al. . | |
| 3,913,656 | 10/1975 | Guyer | 160/351 X |
| 3,965,599 | 6/1976 | Ebner . | |
| 3,968,808 | 7/1976 | Zeigler . | |
| 3,987,567 | 10/1976 | Fritts . | |
| 4,026,313 | 5/1977 | Zeigler . | |
| 4,147,198 | 4/1979 | Ytter . | |
| 4,290,244 | 9/1981 | Zeigler . | |
| 4,619,304 | 10/1986 | Smith . | |
| 4,631,881 | 12/1986 | Charman | 160/135 X |
| 4,635,410 | 1/1987 | Chumbley . | |
| 4,658,560 | 4/1987 | Beaulieu | 248/166 X |
| 4,722,146 | 2/1988 | Kemeny | 160/135 X |

FOREIGN PATENT DOCUMENTS

| | | | |
|---|---|---|---|
| 2096379 | 10/1982 | United Kingdom | 40/575 |

OTHER PUBLICATIONS

Structural Display, Inc., 12-12 33rd Ave., Long Island City, N.Y. 11106, KEPAC TM System.

International Exhibits, Inc., 3625 Mississippi Ave., Portland, Ore. 97227, Fastpack ®.

Dantrade International Ltd., MODUL 280, 18140-107 Ave. Edmonton, Alberta Canada T5S 1K5.

Normadic Structures, Inc., INSTAND 100 series, 205 South Columbus St., Alexandria, Va. 22314.

ODC Exhibit Systems Ltd., ORIGINAL 8 ®, 109-3551 Viking Wy, Richmond, B.C. V6V 1W6.

*Primary Examiner*—David M. Purol

*Attorney, Agent, or Firm*—Wood, Herron & Evans

[57] ABSTRACT

The present invention is directed to a foldable and portable display system which is reconfigurable from a folded portable position to an unfolded display position and which is adapted to display a substantially continuous, unbroken graphic or display surface consisting of a plurality of individual display panels (or one or more display sheets) secured to the frames in a manner to permit the individual panels to be in edgewise abutting relationship to each other, to thereby conceal the hinged mounting frames and which are easily revovable and/or replaceable for an aesthetically pleasing display.

26 Claims, 5 Drawing Sheets

FOLDABLE DISPLAY SYSTEM WITH CONTINUOUS DISPLAY SURFACE

FIELD OF THE INVENTION

The present invention relates to a portable, foldable display system, and more particularly, to a display system that is easily foldable from a large display size to a convenient portable size, and which is adapted to provide a substantially continuous, unbroken display surface when unfolded with the display panel support frames which support the display panels being substantially concealed by the display panels.

BACKGROUND OF THE INVENTION

Portable display systems are used extensively at trade shows as well as in other commercial and business settings for product promotion, information and advertising. The known portable display frames are foldable for compact transport and reconfigurable or unfoldable to a display position. An example of this type of portable display system is disclosed in U.S. Pat. No. 4,436,135. Generally, in portable display systems of this type, a plurality of display panels are individually mounted for display by separate rectangular frames which are hinged together to collectively provide a large display area when the frames are unfolded. The individual display panels are gripped at their outer edges by inner edges of the rectangular frames which typically have a channel configuration into which the display panel edges seat to afford a secure mounting for the display panels. Each display panel, when secured within its respective rectangular frame, has the appearance of a "framed" picture due to the substantial width of each of the four sides of the rectangular frame which are entirely visible when the display panel is mounted within the rectangular frame. Collectively, the display panels, when mounted in their respective rectangular frames, resemble a group of "framed" pictures which are hinged together along the outer edges of their respective rectangular mounting frames.

A serious disadvantage of the foregoing display system is that when it is unfolded and erected into its display position, the plurality of panels which make up the display surface are separated by a grid pattern of frame members, providing a visually disrupted display surface. An additional problem with this type of display system involves the removal and replacement of the display panels when it is desired to change the display, which is not a simple task since each panel is seated or captured at its outer edges within the channels of its associated frame. Removal and/or replacement of display panels requires disassembly and reassembly of the panel frames and thus is not conducive to a rapid, on-site change of display.

Another type of known display system has a plurality of support members pivotally joined to one another to provide a collapsible articulated structure that is portable. Display systems of this general type are disclosed, for example, in U.S. Pat. Nos. 4,471,548 and 4,658,560. These display systems utilize magnetic strips to affix display panels to the display framework; however, the display panels either lie in overlapping edgewise relation to one another or are spaced apart along their vertical edges, thus leaving the frame members visible.

SUMMARY OF THE INVENTION

The present invention overcomes the shortcomings of the prior art display systems by providing a foldable and portable display system which is reconfigurable from a folded portable position to an unfolded display position and which is adapted to display a substantially continuous, unbroken graphic or display surface consisting of a plurality of individual display panels (or one or more display sheets) secured to the frames in a manner to permit the individual panels to be in edgewise abutting relationship to each other, to thereby conceal the hinged mounting frames and which are easily removable and/or replaceable for an aesthetically pleasing display.

In a preferred embodiment, the portable display system of the present invention consists of a vertical and horizontal array of rectangular frames which are hinged together along their vertical edges. Each rectangular frame includes four frame elements or sides, which are preferably extruded aluminum or some other relatively lightweight material. The four sides are joined together using corner-key members at mitered corner joints to form individual rectangular display panel support frames for supporting individual display panels. As noted, the support frames are hingedly connected to one another along their vertical sides, as will be more fully described hereinafter, to provide a foldable, portable display system.

Each of the four frame side members of a rectangular panel support frame has front and rear surfaces and inner and outer edges. The outer edges are those on the outer periphery of the support frames and the inner edges are those on the inner periphery of the support frames. The front surfaces of the four frame side members preferably lie in a single plane, collectively defining a flat rectangular annular front frame surface defined by the inner and outer edges of the four frame side members. The rear surfaces of the four frames side members preferably lie in a single plane, collectively defining a flat rectangular annular rear frame surface defined by the inner and outer edges of the four frame side members. Each frame element further includes a channel extending lengthwise along its front surface in which is disposed means for releasably securing the rear surface of a display panel to the front of the support frame. In addition, the rectangular annular support frame may have such a rectangular channel in its rear rectangular annular surface, as well as its front surface, to permit attachment of both front and rear display panels for two-sided displays. Preferably, the securing means disposed within the rectangular channels in the front and rear annular surfaces are stainless steel (or other magnetically attractable) strips located along the bottom of the channel the edges of which are captured by flanges defining the channels, leaving exposed a substantial portion of the surface of the stainless steel strips. Thus, when the four frame side elements are joined at their corners to form a rectangular panel support frame, there is a rectangular channel in the front (and rear) rectangular annular surface of the support frames having at the bottom thereof the exposed magnetically attractable strip captured therein. For reasons to become apparent hereafter, a substantial portion of the channel above (in the direction normal to the front and rear annular surfaces) the magnetically attractable strips remains empty or unfilled by the strips, effectively leaving a rectangular shallow channel of finite depth above the strips.

The display panels or graphic panels which are used in combination with the panel support frames preferably are made of a thin flexible sheet material and have substantially the same vertical and horizontal dimensions as the exterior dimensions of the support frames such that when a display panel is releasably secured to the front surface of a support frame the support frame is substantially concealed. The display panels are preferably releasably secured to the support frames with the panel edges and support frame outer edges aligned, by means of flexible magnetic strips affixed (with adhesive, for example) to the rear surface of each display panel. When the panel edges and support frame outer edges are in alignment, each magnetic strip is positioned to correspond to overlie and seat in a channel in its respectively associated frame element and thereby magnetically cooperate with the stainless steel strip in the channel to releasably secure the display panel to the support frame. By using magnetic strips which are pre-positioned on the display panels to cooperate with the channels in the frame elements when the edges of the display panels and frame elements are initially set-up, the display panels can be registered or aligned with respect to the edges of the panel support frame itself and other adjacent display panels when subsequently reassembled thereon.

In a preferred embodiment, the magnetic strips on the display panels do not completely fill the channels in the support frames; i.e., the strips are narrower than the channels. This provides some tolerance so that a person assembling the display system can adjust the display panels relative the display frames to accommodate various discrepancies in the display frames which may occur when the system is set-up. For example, adjustments may need to be made when the leg levelers for the display system are not set properly so that adjacent panels are not correctly aligned, or when the support frame corners are not perfectly square, as may occur after repeated use. In these and other situations, the panels can be adjusted relative the frames while maintaining the magnetic strips in the channels to ensure the substantially continuous and unbroken display surface that is desired. It is preferred to align at least one horizontally disposed magnetic strip, and more preferably, one horizontally and one vertically disposed magnetic strip, in its corresponding channel along the inner edge thereof to register the display panel edges with the display frame outer edges and adjacent display panels.

When a large display of multiple display panels is displayed using the display system of this invention, as by releasably securing a plurality of display panels to an array of panel support frames with the edges of the individual display panels registered or aligned with the outer edges of the respectively associated panel support frames, the edges of the contiguous display panels are in abutment, and, the display system provides a substantially continuous and unbroken display surface. Furthermore, the display can be readily changed on-site by simply peeling the display panels away from the panel support frames and replacing them with the desired display panels, which have the magnetic strips attached thereto in a preselected position to facilitate alignment of the panel edges with the frame edges, thereby assuring a continuous and unbroken display surface.

In an alternative embodiment, the display system may have one or more display panels sized to span more than one panel support frame. In this embodiment, the display panels have magnetic strips attached to the rear surface thereof and positioned to cooperate with the channels in the support frames about the peripheral edge of the display panel. At the location where the display panels span adjacent support frame members, the magnetic strips have cut out portions to accommodate the frame members and maintain the smooth display surface.

It will be appreciated that the steel strips disposed within the channels in the frame elements and the magnetic strips affixed to the rear surface of the display panels can be interchanged while achieving the same result. Alternatively, the channels may have magnetic strips disposed therein and the display panels may have reverse polarity magnetic strips affixed to their rear surfaces to likewise achieve the same result of registering or positively locating the display panel edges in abutting relationship with adjacent display panel edges to thereby provide a continuous unbroken display surface.

In a preferred embodiment, the portable display system of this invention comprises one or more horizontal arrays of panel support frames, depending on the size of the display surface desired, in which the vertical frame elements of the panel support frames are hingedly connected to the vertical frame elements of adjacent panel support frames to facilitate folding and unfolding the array of panel support frames in an accordian-like fashion. To this end, flexible hinges allowing 360° rotation of adjacent panel support frames are preferred. By way of example, a horizontal array of four hinged panel support frames can be folded for transportation to a compact condition which has the width and length of a single support frame and the thickness of four support frames. The same array of four support frames can be unfolded to a planar display position which has the length and width of four support frames and the thickness of one support frame.

Oftentimes it is desirable to have a display surface having a height greater than that of a single panel support frame. For example, a display system consisting of two or more horizontal arrays of panel support frames arranged vertically, one above the other, in an unfolded display position provides a taller display surface. When two or more horizontal arrays of support frames are arranged one above the other, the upper horizontal frame element of one of the support frames of the lower array, preferably an end frame, is hingedly connected to the lower horizontal frame element of the corresponding support frame of the upper array such that both arrays can be simultaneously folded in accordian-like fashion to a compact configuration having the length and width of a single frame and a thickness equal to the combined thicknesses of the individual frames of the respective horizontal arrays. Subsequently, the upper array of support frames is folded 180° downward about the hinge between the upper and lower end support frames of the upper and lower horizontal arrays, respectively, so as to be horizontally adjacent the lower array of support frames and thus in a readily portable configuration.

The adjacent upper and lower frame elements of the upper and lower arrays of support frames are preferably not hinged together at other than one panel in order to permit the upper folded array to be folded downward in alignment with the bottom folded array. When the upper and lower arrays are unfolded into the display position, however, it is desirable to releasably secure together the remaining unhinged, vertically adjacent support frames of the upper and lower arrays. To accomplish this, stabilizing clips are disposed in channels which run along the length of the outer edges of the frame elements between the front and rear faces of the frame elements whereby the vertically adjacent frame elements are releasably secured to one another and the corresponding pairs of vertically adjacent upper and lower support frames (one from each array) are releasably held in a planar relationship.

The hinged relationship between the horizontally adjacent support frames of each array facilitates configuration of the display system of this invention in a variety of positions. For example, in its display position, the display system can be configured to have other than a single planar display surface, as by setting up the display system with a 90° or other angle between adjacent display support frames. When set up in other than a single plane display position, the outer edges of the frame elements adjacent the angle are visible. These exposed frame edges can be concealed by snapping a length of edge trim having a ¼-round or 90° cross-section (for example when there is a 90° angle in the display system) to the channels in the exposed outer edges of the adjacent frame elements. The edge trim preferably has a plurality of clip-like projections extending therefrom which engage the channels on the outer edges of the exposed frame elements in a manner similar to the stabilizing clips discussed previously. Alternatively, the edge trim has channels extending lengthwise along the flat, perpendicularly adjacent edges thereof which correspond to the channels on the outer edges of the exposed frame elements such that the stabilizing clips described above can be used to releasably secure the edge trim to the exposed frame elements.

The display system of the present invention is readily portable when in a folded position and can be folded with or without the display panels in place. Preferably, the display system is transported without the display panels in place, however, to avoid any damage thereto. Obviously, where display panels are used which span more than one support frame, those panels must be removed prior to folding the display frames. When the display system is at the desired display location, it is erected by rotating the upper array of support frames 180° to their upright position atop and vertically adjacent the lower array of support frames and releasably locking the adjacent horizontal frame elements with the stabilizing clips. The arrays of support frames are then unfolded to form the desired display surface configuration, i.e., planar or multi-planar. Once the support frames are set up in the desired configuration, the display panels are easily, rapidly and accurately secured to the support frames in abutting, edgewise relation relative one another to provide a continuous, unbroken display surface.

In certain circumstances it is desirable to have one or more shelves extending outwardly from the display surface to display promotional literature or product samples, for example. The display system of the present invention accommodates this need through use of a display shelf rail which is positionable in a support frame extending across the width of the support frame from one vertical frame element to the opposite vertical frame element. The vertical frame elements, each of which has a channel extending along the length of its inner edge, have a plurality of transverse bores in this inner edge channel. In one embodiment, the display shelf rail has prong-like projections extending from the opposite ends thereof which are sized to be received in the transverse bores of the vertical frame elements. Thus, the display shelf rail can be positioned in one of several preselected vertical positions spanning a selected support frame. If desired, a plurality of display shelf rails can be utilized to display a plurality of shelves.

One embodiment of a display shelf rail has three longitudinal channels in its front surface. The upper and lower channels each have a stainless steel strip disposed therein, comparable to the stainless steel strips and channels in the frame elements, to removably secure one edge of a display panel thereto. The third channel, which is disposed parallel to and between the upper and lower channels is adapted to receive the edge of a display shelf or other variety of shelf or hanging brackets. With this configuration, a display shelf can be positioned to extend outwardly from the display shelf rail at essentially any selected vertical plane in a support frame and display panels or graphic panels corresponding to the openings defined by the frame elements and the display shelf rail are releasably securable thereto to provide a substantially unbroken and continuous (except for the shelf) display surface.

These and other features and advantages of the present invention will be more fully understood with reference to the accompanying drawings and the description thereof.

DETAILED DESCRIPTION OF THE INVENTION

Figure 1:
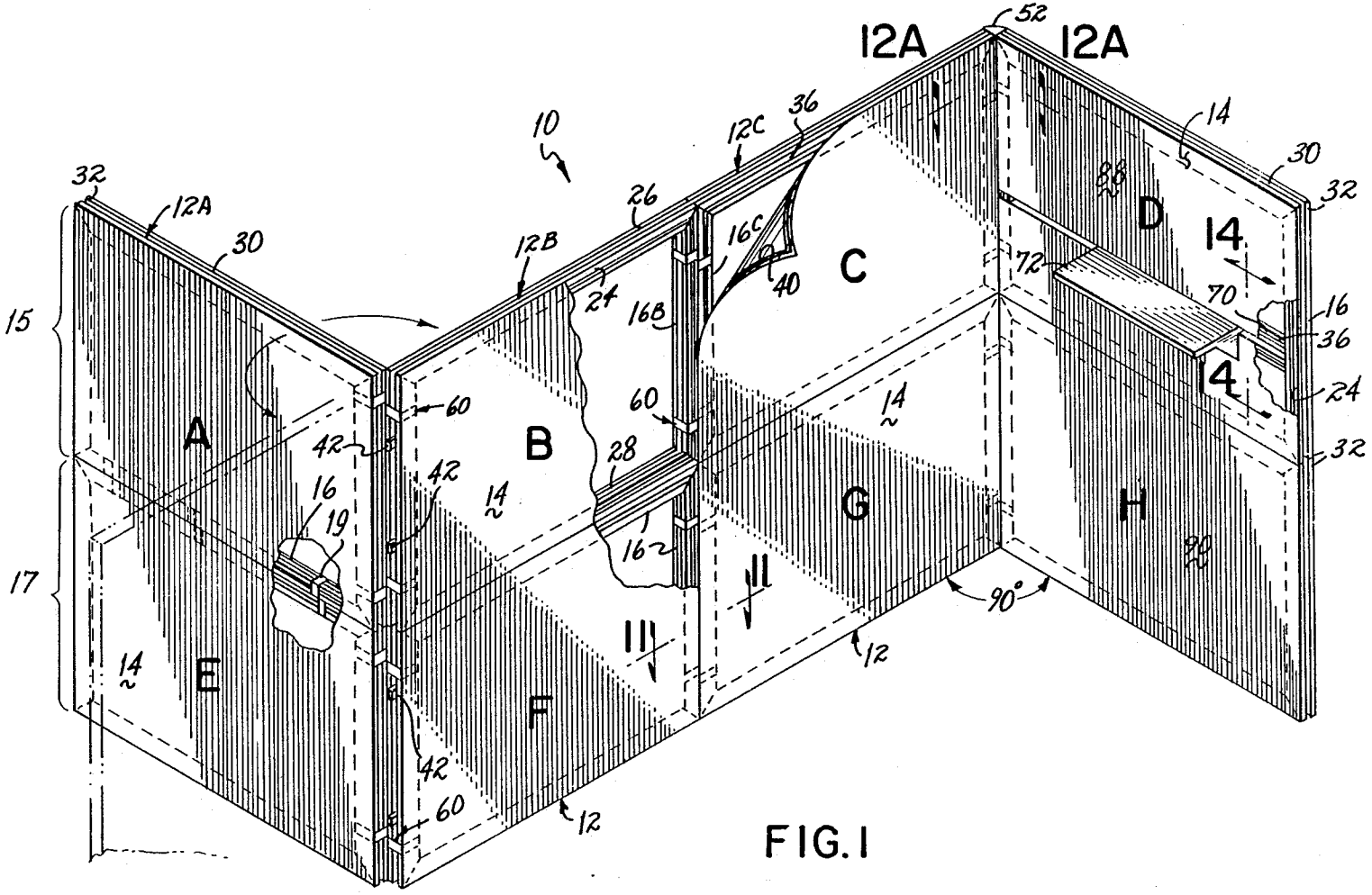
FIG. 1 is a front perspective, partially broken away, of one embodiment of the present invention in an unfolded, display position.

As shown in FIG. 1, one embodiment of the display system 10 of the present invention consists of a plurality of panel support frames 12 to which individual display or graphic panels 14 are releasably securable to provide a substantially continuous, unbroken display surface. Support frames 12 are made up of hollow extruded aluminum frame elements 16. As shown in greater detail in FIGS. 2 and 3, frame elements 16 are joined together in mitered corner joints to form support frames 12 and are held together by means of a corner key 18 which is preferably L-shaped and fits matingly within central channel 20 in frame element 16. In one embodiment, shown best in FIG. 3, corner key 18 has grooved arms 22A and 22B which project into central interior channel 20 of perpendicularly adjacent frame elements 16′ and 16″ and is secured in place by crimping frame elements 16′ and 16″ at the location of the grooves 220 in corner key 18 to prevent support frames 12 from coming apart at their mitered corners. In another preferred embodiment, not shown, rigid L-shaped plates are inserted into channels 34 at the mitered corner joints of adjacent frame elements 16 to further stabilize those joints.

A cross-section of one embodiment of frame element 16 can be seen in any one of FIGS. 1, 5, 11, 12A or 12B. Frame element 16 includes front and rear surfaces 24 and 26, respectively, inner and outer edges 28 and 30, respectively, and opposite ends 32, 32. Front surface 24 includes a shallow channel 34 which extends along the length thereof between opposite ends 32, 32. Channel 34 preferably has a stainless steel (or other magnetically attractable) strip 36 captured therein by flanges 38. During fabrication of support frames 12, steel strip 36 is slid longitudinally into channel 34 of frame element 16 prior to joining frame elements 16 to form support frames 12. Displacement of strip 36 in a direction normal to front surface 24 is prevented by inwardly extending flanges 38′ and 38″ (FIG. 3) and longitudinal displacement may be prevented by crimping the edges of the steel strip at one end (not shown).

Figure 2:
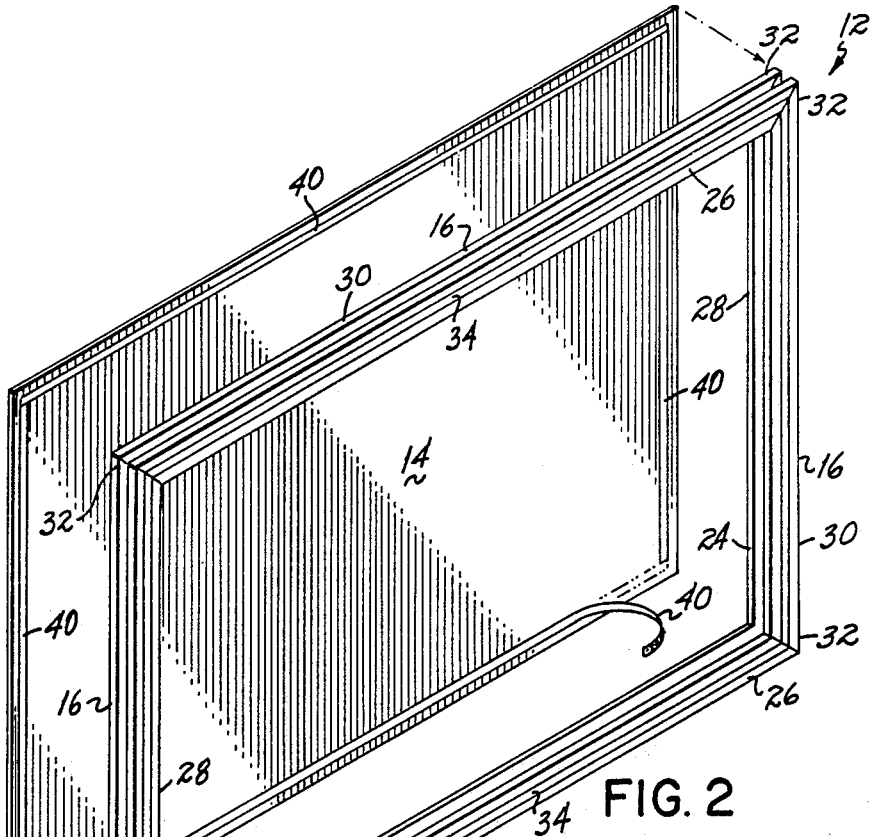
FIG. 2 is a rear perspective of one panel support frame and one display panel in position to be releasably secured to the support frame.
Figure 3:
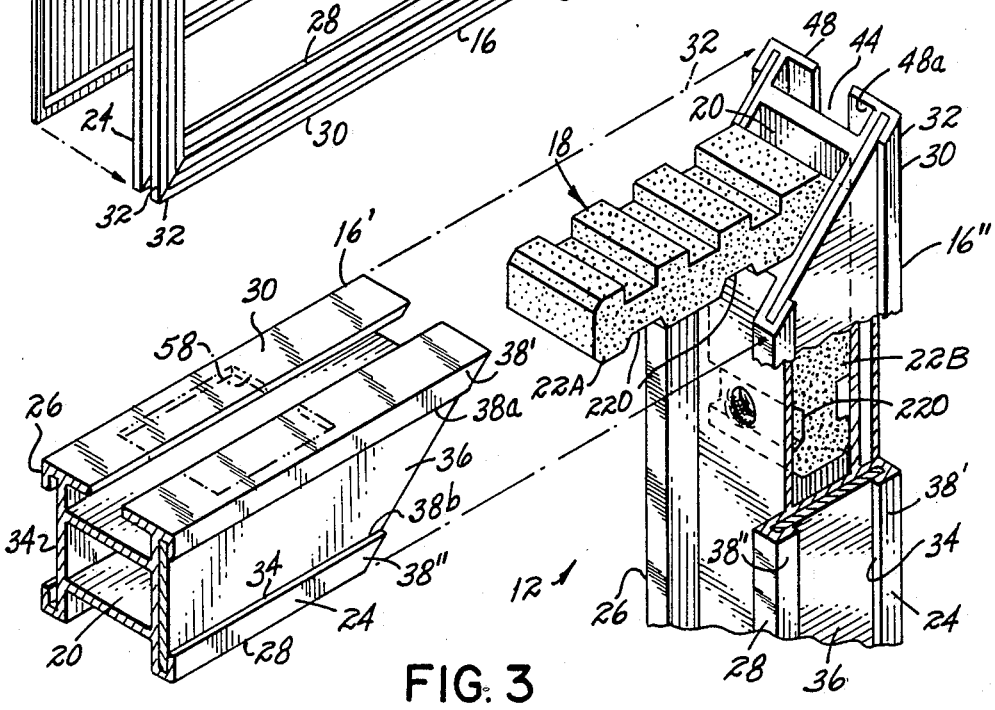
FIG. 3 is an exploded perspective, partially broken away, of the corner construction of a panel support frame.

Display panels 14 are preferably made of a thin flexible sheet material capable of having graphic indicia printed thereon. Alternatively, display panels 14 may have a fabric-like surface capable of displaying other than printed graphics, e.g., the surface may be Velcro (or some other hook-and-eyelet material). As shown in FIG. 2, display panels 14 preferably have flexible magnetic strips 40 affixed thereto, with adhesive for example, which fit (preferably loosely) in the remaining portion of channels 34 defined by the outer surface of the strips 36 and the confronting edges 38*a* and 38*b* of flanges 38′ and 38″. Magnetic strips 40 are releasably magnetically held to steel strips 36 when positioned in the remaining portion of the channels 34 described immediately above. Thus, as shown in FIGS. 1 and 2, display panels 14 can be peeled away from support frames 12 and easily replaced by a different desired graphic panel 14. Magnetic strips 40 are attached to the rear surface of display panels 14 in predetermined positions which correspond to channels 34 in front surfaces 24 of frame elements 16. Due to the cooperation between magnetic strips 40, steel strips 36 and channels 34, when display panels 14 are releasably secured to support panels 12, display panels 14 may be aligned or registered relative to outer edges 30 of frame elements 16 with their edges abutting the edges of adjacent display panels to provide a substantially continuous unbroken display surface in which support frames 12 are substantially hidden from view, as shown best in FIGS. 1 and 11. In a preferred embodiment, magnetic strips 40 are not as wide as channels 34 defined by confronting edges 38*a* and 38*b* of flanges 38′ and 38″ so that adjustment of panels 14 relative support frames 12 is facilitated to ensure the desired continuous unbroken display surface.

In one embodiment, shown in FIG. 1, display system 10 of this invention comprises upper and lower horizontal arrays 15 and 17 of panel support frames A-B-C-D and E-F-G-H. As will be appreciated, additional horizontal arrays of panel support frames can be included to provide a taller display surface, and additional panel support frames can be included in each horizontal array to provide a wider display surface. Adjacent vertical frame elements 16B and 16C of adjacent support frames 12B and 12C of each horizontal array 15 and 17 are hingedly interconnected to allow each horizontal array to be folded and unfolded in an accordian-like manner. Thus, adjacent vertical frame elements 16 in horizontally adjacent pairs of support frames A-B, B-C, and C-D of upper array 15 are hingedly interconnected as are adjacent vertical frame elements 16 in horizontally adjacent pairs of support frames E-F, F-G, and G-H in lower array 17.

To facilitate folding and unfolding support frames 12 from a portable position to a display position, it is preferred that one end pair of vertically adjacent support frames, e.g., support frame pair A-E (as shown in FIG. 1) or D-H, are hingedly interconnected along their adjacent horizontal frame elements as shown, in part, by reference numeral 19. From a planar display position, display system 10 is folded to its portable position by folding frame pairs A-E, B-F, C-G and D-H in an accordian-like manner to a configuration which has the thickness of four support frames, the width of one support frame, and the height of two support frames. Subsequently, upper horizontal array A-B-C-D is folded 180 downward about the hinging means interconnecting support frames A and E to be in its portable position which has the width and height of one support frame and the thickness of eight support frames. Preferably, display system 10 is folded and transported in its portable position without display panels 14 secured thereto; however, display panels 14 may be in place during transportation since they do not interfere in any way with folding or unfolding the display support frames.

The display system of the present invention may be used advantageously with display panels that span more than one support frame. Display panels of this nature, which are not shown, are affixed to the panel support frames in the same manner as the individual display panels described herein.

Figure 9:
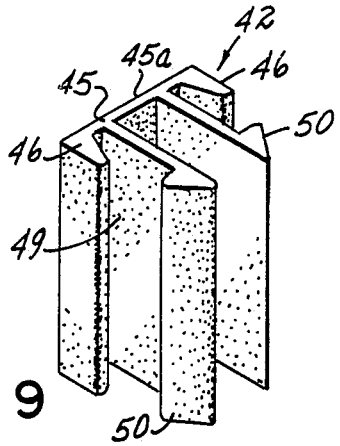
FIG. 9 is a perspective of a stabilizing clip.
Figure 11:
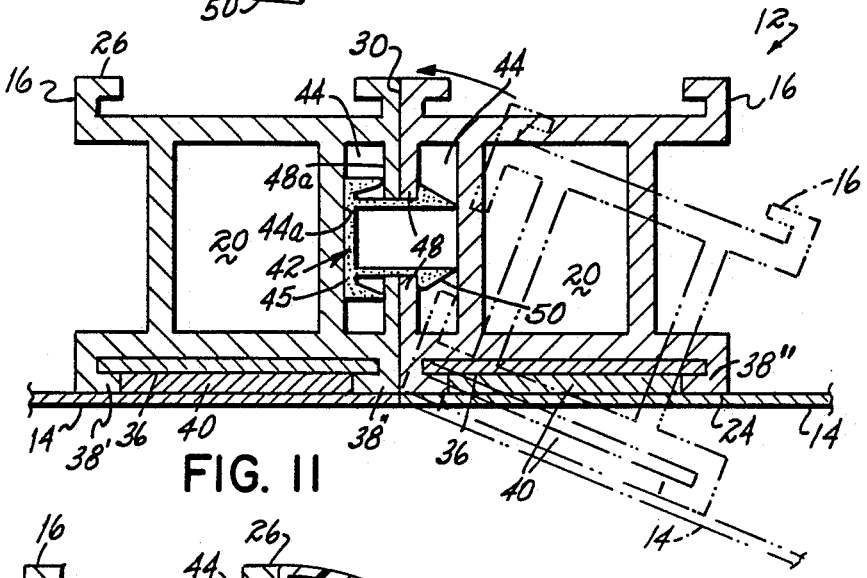
FIG. 11 is a cross-sectional view taken on line 11—11 of FIG. 1 of adjacent frame elements stabilized by the stabilizing clip shown in FIG. 9.
Figure 12A:
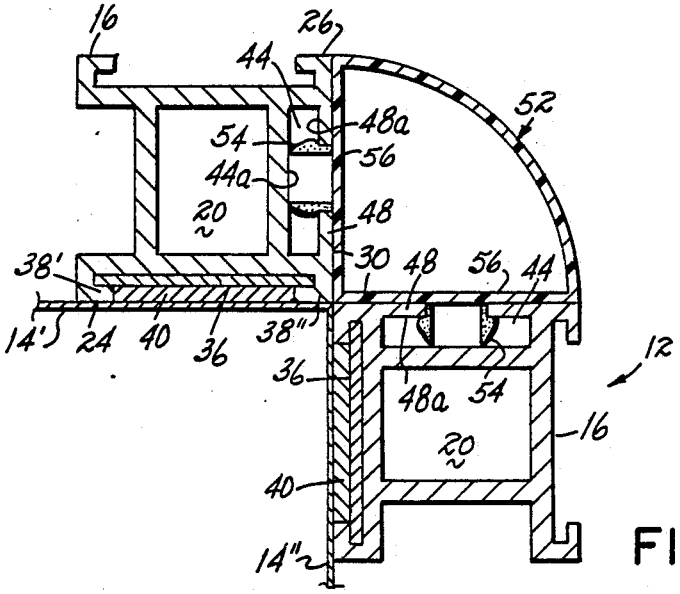
FIG. 12A is a sectional view taken on line 12—12 of FIG. 1 showing adjacent display panel support frames fixed in 90° relation to each other with a ¼-round edge trim member in place.

In its unfolded display position, vertically adjacent support frame pairs B-F, C-G, and D-H, are releasably secured together along their adjacent horizontal frame elements using stabilizing clips 42, shown in FIGS. 9 and 11. Stabilizing clips 42, fabricated of resilent plastic, releasably connect adjacent horizontal frame elements 16 by engaging flanges 48 which partially define channels 44 in outer panel frame edges 30 when vertically adjacent pairs of support frames B-F, C-G and D-H are folded such that the outer edges 30 of each are facing each other, as shown in FIG. 11. Stabilizing clips 42 are designed to fit within channels 44, which extend along the length of outer edges 30 of each frame element 16 with the bottom surface 45*a* of base 45 in contact with the bottom interior surface 44*a* of channel 44. Stabilizing clips 42 include upstanding shoulders 46 extending from a base 45 which engage flanges 48 defining channel 44 of one frame element, and a spaced pair of arms 49 which also extend from base 45, and which terminate at their upper ends in rounded projections 50 which engage the underside 48*a* of flanges 48 of the adjacent frame element 16.

While stabilizing clips 42 are preferably disposed in channels 44, the outer panel frame edges 30 of vertically adjacent frame elements 16, they may also be advantageously disposed in channels 44 of horizontally adjacent confronting frame elements 16 which are already hingedly interconnected to hold those edges together even tighter when the display system is in the display position.

Figure 10:
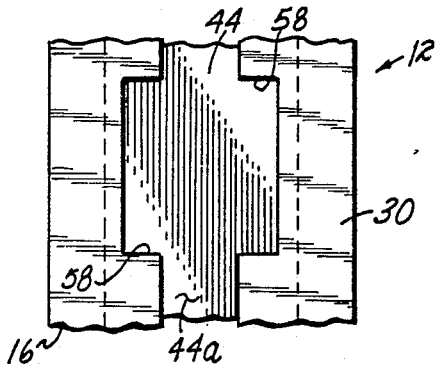
FIG. 10 is a plan view of the inner edge of a frame element showing notches in the flanges which partially enclose the channel for inserting the stabilizing clip shown in FIG. 9.

Stabilizing clips 42 may be mounted to frame elements 16 prior to assembling frame elements into support frames 12 by sliding each clip along channel 44 from an end 32 of the frame element. Breakage of clips 42 may occur during folding and unfolding of display system 10 requiring replacement of clips 42 after the support frames have been assembled. To avoid having to disassemble support frames 12 to replace clips 42, notches 58, as shown in FIG. 10, may be provided in flanges 48 at spaced intervals, to facilitate inserting replacement or additional stabilizing clips 42, as necessary.

Due to the hinged relationship between horizontally adjacent support frames, display system 10 can be set up with an angled display surface. For example, FIG. 1 shows a 90° angle between adjacent display panel pairs C-G and D-H. When an angled display surface is desired, outer edges 30 of the adjacent vertical support members are visible and can be concealed with edge trim 52 as shown for example in FIG. 12A. Edge trim 52 has a ¼-round or 90° angular cross-section and is used to conceal outer edges 30 of an outside corner when adjacent support frames form an inner corner 90° angle; however, it will be appreciated that edge trim having other angular cross sections can be used to conceal outer edges 30 when other display surface angles are desired. Edge trim 52 has perpendicular surfaces 56 (see FIG. 12A) which abut outer edges 30 of frame elements 16. Additionally, surfaces 56 have projections 54 extending outwardly therefrom which engage flanges 48 defining channels 44 in outer edges 30 of adjacent frame elements 16 to releasably secure edge trim 52 thereto. Edge trim 52 thus provides an aesthetically pleasing outside corner structure when the display system is set up with a 90° interior angle between display panels 14' and 14''.

Figure 12B:
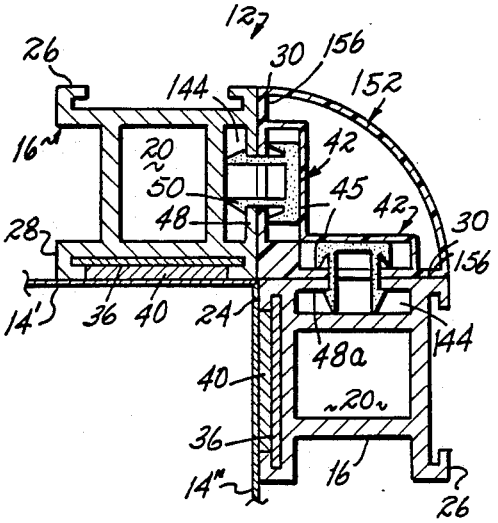
FIG. 12B shows an alternative embodiment of the ¼-round edge trim shown in FIG. 12A.

In an alternative embodiment, shown in FIG. 12B, edge trim 152 has perpendicular surfaces 156 Which abut outer edges 30 of frame elements 16. Surfaces 156 have longitudinal channels 144 therein which are identical to and correspond with channels 44 in outer edges 30 of frame elements 16. In this embodiment, edge trim 152 is releasably secured to frame elements 16 by means of clips 42 in the same manner that adjacent frame elements 16 are releasably secured together, as described herein.

Figure 4:
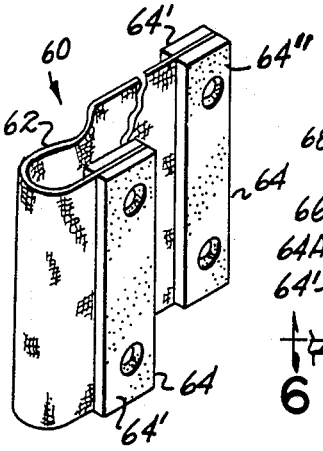
FIG. 4 is a perspective of one type of hinge used in the display system of this invention.
Figure 5:
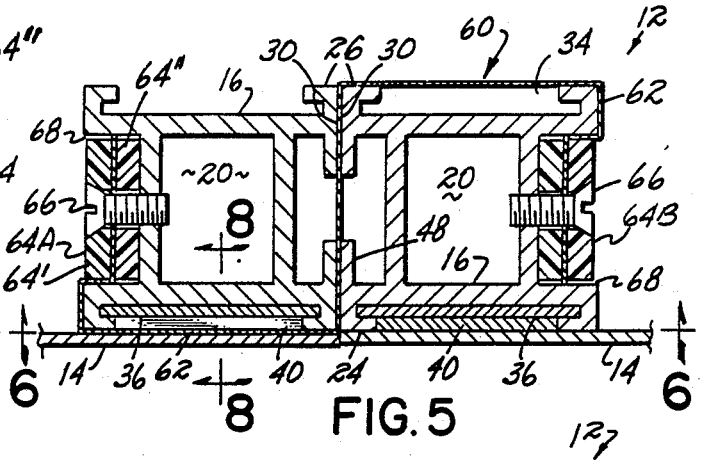
FIG. 5 is a cross-sectional view taken on 5—5 of FIG. 1 of adjacent frame members with display panels affixed thereto showing a typical hinge structure.
Figure 6:
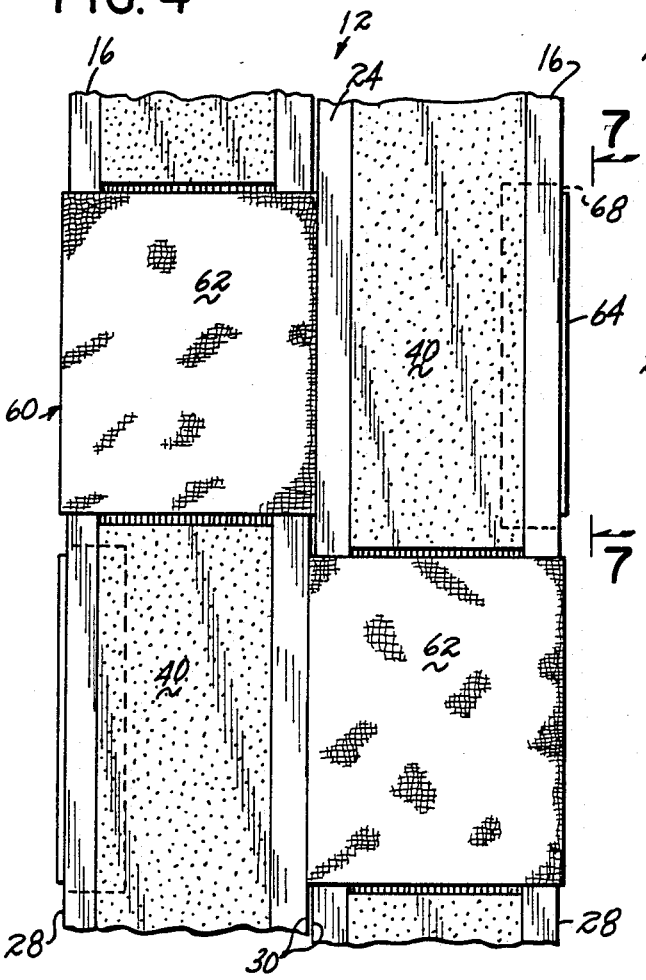
FIG. 6 is a side view of the outer edges of two adjacent support panels in an unfolded position further showing a typical hinge construction.
Figure 7:
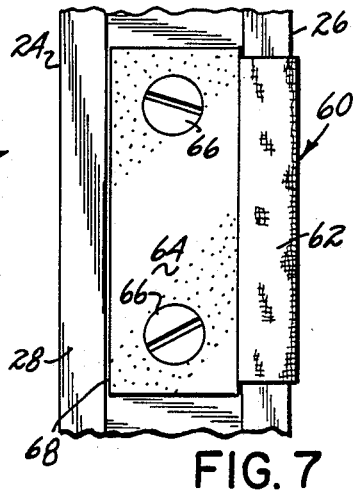
FIG. 7 is a side view taken on line 7—7 of FIG. 6 showing the means for attaching the hinge to the frame element.
Figure 8:
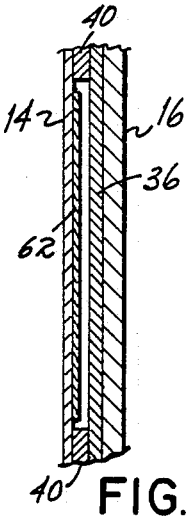
FIG. 8 is a cross-sectional view taken on line 8—8 of FIG. 5 showing a display panel releasably secured to a frame member.

A preferred form of hinge structure for hingedly interconnecting adjacent panel support frames is shown in FIGS. 4–8. FIG. 4 shows hinge member 60 which consists of a flexible strip of material 62, the ends of which are captured in, or sandwiched between, molded plastic tabs 64', 64''. Preferably, the end of the fabric band 62 is anchored to the tabs 64' and 64'' when the tabs are formed by the injection molding techniques with the band end located in the mold cavity during the tab molding operation. Flexible material 62 preferably is a thin, strong, lightweight woven material such as nylon. As shown in FIGS. 5 and 7, tabs 64 are secured in channels 68 in inner edges 28 of frame elements 16 by means of screws 66. FIG. 5 shows two adjacent frame elements 16 in abutting edge-wise relationship with outer edges 30 of each facing one another. In this configuration, display panels 14 are attached to frame elements 16 in planar abutting relationship and one tab 64A of hinge member 60 is secured to the left frame element 16 while the other tab 64B is attached to the right frame element 16. Flexible strip 62 passes from the tab 64A along front edge 24 of left frame element 16, between abutting outer edges 30, 30 of frame elements 16, along rear surface 26 of right frame element 16 to the other end tab 64B in an S-shaped path. As shown in FIGS. 5 and 6, two hinge members 60 are preferably used adjacent one another with flexible strips 62 following opposite S-shaped paths so that adjacent support frames 12 are held together and yet are rotatable 360° so that front surfaces 24 of adjacent support frames are facing each other or, after rotation, rear surfaces 26 of adjacent support frames are facing each other. In this way, the horizontal arrays of support frames which are hingedly interconnected can be folded in an accordian-like manner, as described hereinabove. As shown in FIG. 8, magnetic strip 40 affixed to display panel 14 preferably has a notch cut therein so that when display panel 14 is affixed to support frame 12, the notch in the magnetic strip aligns with the section of flexible material 62 of hinge member 60 which passes across front surface 24 of frame elements 16 so as to maintain a smooth surface.

Figure 13:
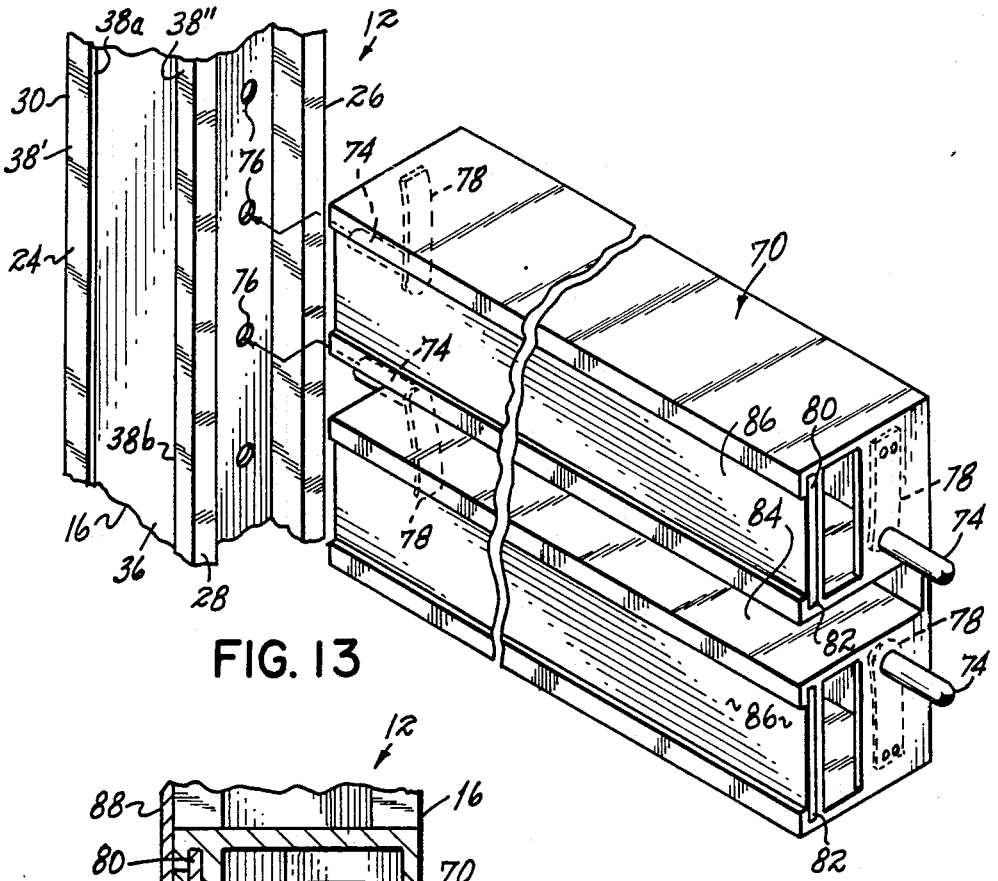
FIG. 13 is an exploded perspective of a display shelf rail relative a display panel support frame element.
Figure 14:
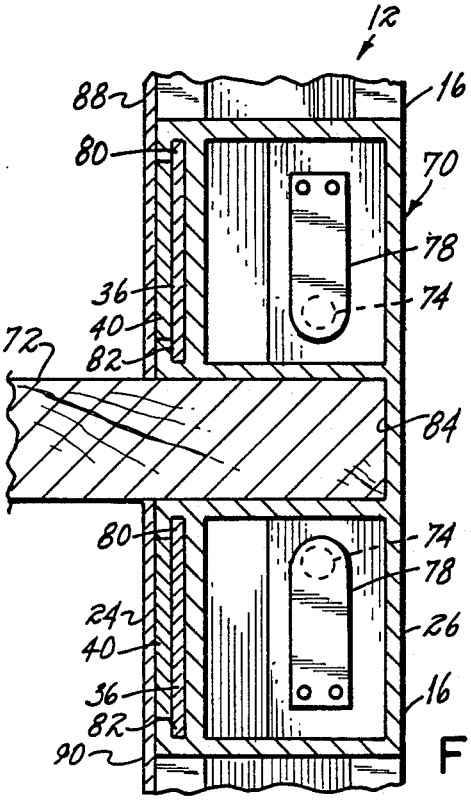
FIG. 14 is a sectional view taken on line 14—14 of FIG. 1 of the display shelf rail of FIG. 1.

As shown in FIG. 1, display system 10 of the present invention may further include display shelf rail 70 for supporting display shelf 72. As shown more particularly in FIGS. 13 and 14, display shelf rail 70 includes prong-like projections 74 at the opposite ends thereof which are engagable in transverse bores 76 in channels 68 in inner edges 28 of frame members 16. A plurality of transverse bores 76 are provided in frame members 16 such that display shelf rail 70 can be positioned at one of several desired vertical planes spanning support frame 12. In one embodiment, prong-like projections 74 project from deformable spring-like members 78 to facilitate inserting and removing display shelf rail 70 in a pre-assembled support frame 12. Preferably, the front surface of display shelf rail 70 lies in the same plane as front surfaces 24 of frame elements 16, when in place. Display shelf rail further includes three longitudinal channels in the front surface thereof. Upper channel 80 and lower channel 82 in display shelf rail 70 have steel strips 86 captured therein (similar to steel strips 36 captured in channels 34 of frame elements 16) to releasably secure an edge of a display panel having a magnetic strip affixed thereto. Central channel 84 is adapted to receive display shelf 72 therein. Thus, when display shelf rail 70 is in place with display shelf 72 projecting outwardly therefrom, display support frame 12 and shelf rail 70 cooperate to accommodate two display panels, 88 and 90, each of lesser area than display panels 14 to maintain the substantially continuous, unbroken (except for the shelf) display surface.

It will be understood by those skilled in the art that the foregoing disclosure is representative of preferred forms and adaptations of the invention and is to be interpreted in an illustrative rather than a limiting sense, the invention to be accorded the full scope of the claims appended hereto.

What is claimed is:

1. A portable display system comprising:

a plurality of display panels having front and rear surfaces;

a plurality of vertical and horizontal frame elements defining an array of panel support frames, each said frame element having inner and outer edges, front and rear surfaces and opposite ends, at least said front surface of each said frame element having a front channel therein, means joining each said frame element at its opposite ends to two perpendicularly adjacent frame elements so as to form a rectangular panel support frame;

means hingedly joining adjacent vertical frame elements of said panel support frames such that said array of support frames is reconfigurable from a folded, portable position to an unfolded, display position; and means for releasably securing each said display panel to a panel support frame with the peripheral edges of said panel and the outer edges of said frame being in aligned registration with each other so as to provide a substantially continuous and unbroken display surface when said array of support frames is in an unfolded, display position, said securing means including a first member located in said front channel and a second member attached to the rear surface of said display panel, said second member adapted to seat in said front channel and being located relatiVe to the peripheral edges of said panel such that when said second member is seated in said front channel, said peripheral edges of said panel are in said aligned registration with said outer edges of said panel support frame, said first and second members being magnetically attractive to each other to releasably secure said display panel to said support frame in aligned registration therewith.

2. The display system of claim 1 wherein each said frame element has a second channel therein extending lengthwise along said outer edge thereof such that adjacent frame elements present opposing second channels and further comprising a plurality of stabilizing clips disposed in said second channels for releasably securing adjacent frame elements of adjacent panel support frames together in close abutting edge-wise relation along their outer edges by engaging said opposing second channels.

3. The display system of claim 2 wherein said frame elements are extruded aluminum and have a third channel therein extending lengthwise through the center thereof, and wherein said joining means is an L-shaped corner key having perpendicular legs, said legs sized to fit matingly in said third channel of each of two perpendicularly adjacent frame elements to join said frame elements in 90° relation to one another such that four frame elements so joined together form a rectangular panel support frame.

4. The display system of claim 1 or 3 wherein each said frame element has a fourth channel therein which extends lengthwise along said inner edge thereof, and wherein said hinging means comprises two strips of flexible material, the ends of each of which are captured in molded plastic tab members, each said tab member of each strip fixed in a said fourth channel of adjacent frame elements of adjacent support panels such that said flexible strips are in oppositely facing S-shaped configuration when said display system is in a planar display position.

5. The display system of claim 2 wherein said second channel in each said frame element has shoulder-like flanges extending partially across the opening of said channel, said flanges having notches therein to facilitate insertion of said stabilizing clips in said second channel along said frame element without disassembly of said panel support frame.

6. The display system of claim 4 wherein each support frame has first and second vertical frame elements and first and second horizontal frame elements and further comprising a display shelf rail removably positionable in said support frame extending from said first vertical frame element to said second vertical frame element.

7. The display system of claim 6 wherein said display shelf rail has prong-like projections extending from the ends thereof and said first and second vertical frame elements have a plurality of transverse bores in said fourth channel thereof for receiving said prong-like projections such that said shelf rail can be positioned in said support frame at one of several selected positions.

8. The display system of claim 7 wherein said display shelf rail has a front surface having first and second longitudinal channels therein and means disposed between said first and second channels for releasably securing a display shelf thereto, said first and second channels having means disposed therein for releasably securing a display panel thereto.

9. The display system of claim 1 wherein said display panel securing means is a stainless steel strip disposed in said front channels which cooperate magnetically with corresponding vertical and horizontal flexible magnetic strips affixed to the display panels to releasably secure the display panels to said panel support frames.

10. The display system of claim 9 wherein each said front channel has a pair of oppositely extending flanges terminating in confronting edges, said flanges each having an inwardly facing surface which overlies said steel strip to collectively capture it, and said confronting edges of said flanges in combination with the outer surface of said steel strip defining a display panel locating channel into which said magnetic strips are seatable to engage said stainless steel strips and secure said display panel to said support frame allowing the outer edges thereof to be in aligned registration with said outer edges of said frame elements and adjacent display panels.

11. The display system of claim 10 wherein at least one of said magnetic strips is registered with respect to a confronting edge of a corresponding locating channel to align the outer edges of said display panel and said support frame.

12. The display system of claim 10 wherein at least one of said vertical and one of said horizontal magnetic strips is registered with respect to a confronting edge of a corresponding locating channel to align the outer edges of said display panel and said support frame.

13. A portable display system comprising:

a plurality of vertical and horizontal frame elements defining an array of panel support frames, each said frame element having inner and outer edges, front and rear surfaces and opposite ends, at least said front surface of each said frame element having a front channel therein in which is disposed means for releasably securing a display panel to said frame element;

a plurality of display panels having front and rear surfaces, each said display panel corresponding to a said panel support frame and having second securing means affixed to said rear surface thereof which cooperate with said securing means in said front channels of said frame elements to releasably secure said display panels to said support frames;

means joining each said frame element at its opposite ends to two perpendicularly adjacent frame elements so as to form a panel support frame;

means hingedly joining adjacent vertical frame elements of said panel support frames such that said array of support frames is reconfigurable from a folded, portable position to an unfolded, display position;

said front channels and said securing means therein in said frame elements and said second securing means on said display panels cooperate such that the edges of each said display panel releasably secured to each panel support frame are registered with respect to said outer edges of said frame elements and adjacent display panels so as to provide a substantially continuous and unbroken display surface when said array of support frames is in an unfolded, display position.

14. The display system of claim 13 wherein each said frame element has a second channel therein extending lengthwise along said outer edge thereof such that adjacent frame elements present opposing second channels and further comprising a plurality of stabilizing clips disposed in said second channels for releasably securing adjacent frame elements of adjacent support panels together in abutting edgewise relation along their outer edges by engaging said opposing second channels.

15. The display system of claim 14 wherein said frame elements are extruded aluminum and have a third channel therein extending lengthwise through the center thereof, and wherein said joining means is an L-shaped corner key having perpendicular legs, said legs sized to fit matingly in said third channel of each of two perpendicularly adjacent frame elements to join said frame elements in 90° relation to one another such that four frame elements so joined together form a rectangular panel support frame.

16. The display system of claim 13 or 15 wherein each said frame element has a fourth channel therein which extends lengthwise along said inner edge thereof, and wherein said hinging means comprises two strips of flexible material, the ends of each of which are captured in molded plastic tab members, each said tab member of each strip fixed in a said fourth channel of adjacent frame elements of adjacent support panels such that said flexible strips are in oppositely facing S-shaped configuration when said display system is in a planar display position.

17. The display system of claim 14 wherein said second channel in each said frame element has shoulder-like flanges extending partially across the opening of said channel, said flanges having notches therein to facilitate insertion of said stabilizing clips in said second channel along said frame element.

18. A portable display system comprising:

a plurality of rectangular display panels having front and rear surfaces, a plurality of rectangular panel support frames defining an array thereof, each frame having inner and outer edges and front and rear surfaces, said front surface of each panel support frame having a front channel therein, means hingedly joining adjacent panel support frames along their vertical abutting edges when said support frames are arranged in side-by-side relation to enable said array of frames to be selectively configured between a folded, portable position and an unfolded, display position, means releasably securing each said display panel to a panel support frame with the peripheral edges of said panel and the outer edges of said frame being in aligned registration with each other so as to provide a substantially continuous and unbroken display surface when said array of support frames is in an unfolded, display position, said securing means including a first member located in said front channel and a second member attached to the rear surface of said display panel, said second member adapted to seat in said front channel and being located relative to the peripheral edges of said panel such that when said second member is seated in said front channel, said peripheral edges of said panel are in said aligned registration with said outer edges of said panel support frame, said first and second members being magnetically attractive to each other to releasably secure said display panel to said support frame in aligned registration therewith.

19. Display system of claim 18 wherein each said panel support frame has channels in its inner edges and wherein said hinging means comprises a fabric band having tabs anchored to the ends thereof, said tabs adapted to seat in said inner edge channels to permit said outer edges of adjacent support frames to closely abut.

20. The display system of claim 18 wherein said hinged vertical abutting edges have vertical slots therein and further comprising a plurality of clips disposed in said vertical slots to cause said hinged abutting vertical edges to be held in close abutment.

21. A portable display system comprising:

a plurality of rectangular display panels having front and rear surfaces, a plurality of rectangular panel support frames defining an array thereof, each frame having inner and outer edges and front and rear surfaces, said front surface of each panel support frame having a front channel therein, means hingedly joining adjacent panel support frames along their vertical abutting edges when said support frames are arranged in side-by-side relation to enable said array of frames to be selectively configured between a folded, portable position and an unfolded, display position, means releasably securing each said display panel to a panel support frame with the peripheral edges of said panel and the outer edges of said frame being in aligned registration with each other so as to provide a substantially continuous and unbroken display surface when said array of support frames is in an unfolded, display position, said securing means including a first member located in said front channel and a second member attached to the rear surface of said display panel, said second member adapted to seat in said front channel, said first and second members being magnetically attractive to each other to releasably secure said display panel to said support frame in aligned registration therewith.

22. A portable display frame system for use in combination with a plurality of display panels having flexible magnetic strips affixed to the rear surface thereof adjacent the peripheral edges of the panels, said frame system comprising:

a plurality of vertical and horizontal frame elements defining an array of panel support frames, each said frame element having inner and outer edges, front and rear surfaces and opposite ends, at least said front surface of each said frame element having a front channel therein in which is disposed means which cooperates with the magnetic strips on the display panels for releasably securing a display panel to a support frame;

means joining each said frame element at its opposite ends to two perpendicularly adjacent frame elements so as to form a panel support frame;

means hingedly joining adjacent vertical frame elements of said panel support frames such that said array of support frames is reconfigurable from a folded, portable position to an unfolded, display position;

said front channels and said securing means therein in said frame elements and the magnetic strips on the display panels adapted to cooperate such that the edges of the display panels releasably secured to said panel support frames can be registered and aligned with respect to said outer edges of said frame elements and adjacent display panels so as to provide a substantially continuous and unbroken display surface when said array of support frames is in an unfolded, display position.

23. The frame system of claim 22 wherein said securing means is a stainless steel strip disposed in said front channels which cooperates magnetically with corresponding vertical and horizontal flexible magnetic strips affixed to the display panels to releasably secure the display panels to said panel support frames.

24. A portable display system comprising:

a plurality of vertical and horizontal frame elements defining an array of panel support frames, each said frame element having inner and outer edges, front and rear surfaces and opposite ends, at least said front surface of each said frame element having a front channel therein for releasably securing a display panel to said frame element;

a plurality of display panels having front and rear surfaces, each said display panel corresponding to a said panel support frame and having securing means affixed to said rear surface thereof which cooperate with said front channels of said frame elements to releasably secure said display panels to said support frames;

means joining each said frame element at its opposite ends to two perpendicularly adjacent frame elements so as to form a panel support frame;

means hingedly joining adjacent vertical frame elements of said panel support frames such that said array of support frames is reconfigurable from a folded, portable position to an unfolded, display position;

said front channels and said securing means on said display panels magnetically cooperate such that the edges of each said display panel releasably secured to each panel support frame are registered with respect to said outer edges of said frame elements and adjacent display panels so as to provide a substantially continuous and unbroken display surface when said array of support frames is in an unfolded, display position.

25. A portable display system comprising:

a plurality of vertical and horizontal frame elements defining an array of panel support frames, each said frame element having inner and outer edges, front and rear surfaces and opposite ends, at least said front surface of each said frame element having a front channel therein and means associated therewith for releasably securing a display panel to said frame element;

a plurality of display panels having front and rear surfaces, each said display panel corresponding to a said panel support frame and having securing means associated with said rear surface thereof which magnetically cooperate with said securing means associated with said front surface of said frame elements to releasably secure said display panels to said support frames, said display panels also having locating means affixed to the rear surface thereof;

means joining each said frame element at its opposite ends to two perpendicularly adjacent frame elements so as to form a panel support frame;

means hingedly joining adjacent vertical frame elements of said panel support frames such that said array of support frames is reconfigurable from a folded, portable position to an unfolded, display position;

said front channels and said locating means on said display panels cooperate such that the edges of each said display panel releasably secured to each panel support frame are registered with respect to said outer edges of said frame elements and adjacent display panels so as to provide a substantially continuous and unbroken display surface when said array of support frames is in an unfolded, display position.

26. A portable display system comprising:

a plurality of rectangular display panels having front and rear surfaces;

a plurality of rectangular panel support frames defining an array thereof, each frame having inner and outer edges and front and rear surfaces;

one of said display panel rear surface and said panel support frame front surface including means defining at least one vertical channel and one horizontal channel, and the other of said display panel rear surface and said panel support frame front surface including vertical and horizontal locating means adapted to seat in said vertical and horizontal channels, said locating means and said channels cooperating such that the peripheral edges of each said panel and the outer edges of each said frame are in aligned registration with each other;

means hingedly joining adjacent panel support frames along their vertical abutting edges when said support frames are arranged in side-by-side relation to enable said array of frames to be selectively configured between a folded, portable position and an unfolded, display position;

means releasably securing each said display panel to a panel support frame with the peripheral edges of said panel and the outer edges of said frame being in aligned registration with each other so as to provide a substantially continuous and unbroken display surface when said array of support frames is in an unfolded, display position;

said securing means including a first member located on said support frame and a second member on said display panel rear surface, said first and second members cooperating to secure each said panel to a support frame.

* * * * *